US005081401A

United States Patent [19]

Moisin

[11] Patent Number: 5,081,401

[45] Date of Patent: Jan. 14, 1992

[54] DRIVER CIRCUIT FOR A PLURALITY OF GAS DISCHARGE LAMPS

[75] Inventor: Mihail S. Moisin, Lake Forest, Ill.

[73] Assignee: Motorola, Inc., Schaumburg, Ill.

[21] Appl. No.: 580,430

[22] Filed: Sep. 10, 1990

[51] Int. Cl.[5] ..... H05B 41/00

[52] U.S. Cl. ..... 315/324; 315/122; 315/228; 315/250; 315/276; 315/DIG. 5

[58] Field of Search ..... 315/324, DIG. 5, 228, 315/229, DIG. 2, 122, 188, 191

[56] References Cited

U.S. PATENT DOCUMENTS

| | | | |
|---|---|---|---|
| 2,358,810 | 9/1944 | Karash | 315/188 |
| 2,637,833 | 5/1953 | Skrotzki | 315/187 |
| 3,956,665 | 5/1976 | Westphal | 315/122 |
| 4,006,384 | 2/1977 | Elms et al. | 315/DIG. 5 |
| 4,323,823 | 4/1982 | Boggavarapu | 315/254 |
| 4,399,391 | 8/1983 | Hammer et al. | 315/244 |
| 4,413,209 | 11/1983 | Roche | 315/DIG. 5 |
| 4,912,372 | 3/1990 | Mongoven et al. | 315/122 |

*Primary Examiner*—Eugene R. LaRoche
*Assistant Examiner*—Son Dinh

[57] ABSTRACT

A circuit (100) for driving a plurality of gas discharge lamps (102, 104), and having: input terminals (126, 130) for connection to a source of voltage supply; output terminals (134, 136, 140) for connection to the lamps in series; an oscillator (124, 132) connected between the input terminals and the output terminals for producing a high-frequency drive voltage at the output terminals; a transformer (106) having a primary winding (108) coupled to the input terminals and having a secondary winding (114) coupled to the output terminals, the transformer secondary winding being coupled at its ends (116, 118) and at an intermediate point (120) to respective ones of the output terminals and the intermediate point (120) of the transformer secondary winding being coupled to its respective output terminal (140) by a capacitor. The capacitor serves to enhance striking of one of the lamps after the other has struck, and provides an alternative path for current to one of the lamps if the other ceases to function or is removed.

16 Claims, 3 Drawing Sheets

DRIVER CIRCUIT FOR A PLURALITY OF GAS DISCHARGE LAMPS

BACKGROUND OF THE INVENTION

This invention relates to driver circuits for a plurality of gas discharge lamps.

In a conventional prior art driver circuit for a plurality of gas discharge lamps a single set of output terminals is provided and the lamps are connected in series between the single set of output terminals. In use of such a driver circuit, if one of the lamps fails or is removed, drive is no longer applied to the remaining lamp or lamps.

From U.S. Pat. No. 4,503,361 it is known to connect a respective capacitor in parallel with each of two gas discharge lamps. The function of each capacitor is to change the resonant frequency and power factor of the driver circuit when effectively brought into circuit if its respective lamp is removed. However, the purpose of the change is to protect transistor components of the drive circuit from high voltages rather than to ensure continued drive to the other lamp: in order to ensure that the lamps are driven independently the two lamps are driven from separate transformers.

From U.S. Pat. No. 4,525,649 it is known to connect the filaments of a plurality of gas discharge lamps in series, with the filaments of each lamp being connected via a respective capacitance. The capacitances are chosen so as to present (i) a lower impedance to drive current before the lamps become lit so as to allow the filaments to be heated, and (ii) a higher impedance to drive current after the lamps become lit so as to minimize power consumption subsequent to ignition of the lamps.

SUMMARY OF THE INVENTION

It is an object of the present invention to provide an improved driver circuit for a plurality of gas discharge lamps wherein the above disadvantages may be overcome or at least alleviated.

In accordance with a first aspect of the invention there is provided a circuit for driving a plurality of gas discharge lamps, the circuit comprising:

- input terminals for connection to a source of voltage supply;
- output terminals for connection to a plurality of gas discharge lamps in series;
- high-frequency drive means connected between the input terminals and the output terminals for producing a high-frequency drive voltage at the output terminals;
- a transformer having a primary winding coupled to the input terminals and having a secondary winding coupled to the output terminals,
- the secondary winding of the transformer being coupled at first and second points along its length and at at least one point intermediate between the first and second points to respective ones of the output terminals, and
- at least one intermediate point of the secondary winding of the transformer being coupled to its respective output terminal by a respective capacitance.

In a preferred embodiment of the invention two lamps are connected in series across the transformer secondary winding, and a point intermediate between the two lamps is coupled to a center tapping on the transformer secondary winding via a capacitor. The capacitor serves to enhance striking of one of the lamps after the other has struck, and provides an alternative path for current to one of the lamps if the other ceases to function or is removed.

BRIEF DESCRIPTION OF THE DRAWINGS

Eight gas discharge lamp driver circuits in accordance with the present invention will now be described, by way of example only, with reference to the accompanying drawings, in which.

DESCRIPTION OF THE PREFERRED EMBODIMENT

Figure 1:
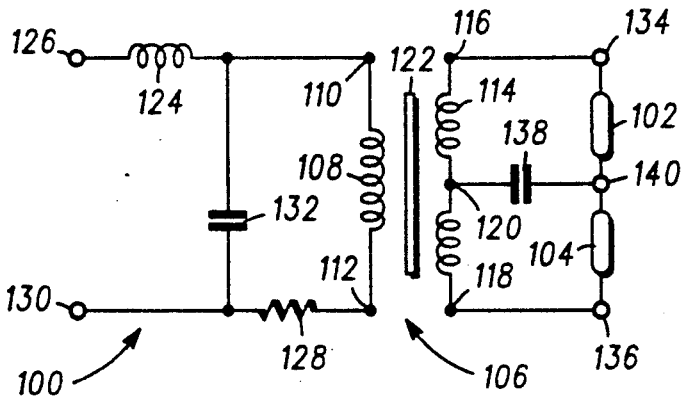
FIGS. 1 to 8 show schematic circuit diagrams of respective ones of the eight gas discharge lamp driver circuits.

Referring now to FIG. 1, a first driver circuit 100 for driving two gas discharge lamps 102, 104 includes a transformer 106. The transformer 106 has a primary winding 108 between terminals 110, 112, and has a secondary winding 114 between terminals 116, 118; the secondary winding is center tapped at a terminal 120. The primary and secondary windings are wound on a core 122 in a total turns ratio of 1:1. The terminal 110 of the primary winding 108 is connected, via a series inductor 124 having an inductance of approximately 2 mH, to an input terminal 126. The terminal 112 of the primary winding 108 is connected, via a series resistor 128, to an input terminal 130. The resistor 128 serves to sense load current in operation of the circuit and so has a very low value of typically 0.5 Ω. A capacitor 132 having a value of approximately 0.015 μF is connected in parallel with the primary winding 108 between the terminal 110 of the primary winding and the input terminal 130.

The secondary winding terminals 116 and 118 are connected directly to output terminals 134 and 136 respectively. The secondary winding terminal 120 is connected, via a series capacitor 138 having a value of approximately 0.01 μF, to an output terminal 140. The gas discharge lamps 102, 104 (which may typically be conventional fluorescent lamps) are connected in series between the output terminals 134 and 140 and between the output terminals 140 and 136 respectively.

For simplicity of illustration, lamp filament heater windings, which would typically be provided from the same transformer 106 in conventional manner, are not shown.

In use of the driver circuit 100, alternating mains voltage (e.g. 120 VAC, 60 Hz) is applied across the input terminals 126, 130. The inductor 124 and the capacitor 132 form an LC resonant circuit which, energized by the applied mains voltage resonates at a chosen frequency of approximately 30 KHz and at a chosen peak voltage of approximately 600 V. The high-frequency voltage produced by the resonant circuit appears across the primary winding terminals 110, 112 of the transformer 106. The high-frequency voltage produced by the resonant circuit is conveyed by the transformer 106 and appears across the secondary winding terminals 116, 118. The high-frequency voltage produced by the resonant circuit thus appears across the output terminals 134, 136, and so across the series-connected lamps 102, 104.

When the high-frequency voltage first appears across the output terminals 134, 136, and while the lamps remain unlit, the lamps each present the same impedance, and to each of the lamps is applied half (approximately 300 V) of the high-frequency voltage across the output terminals 134, 36. Thus, the output terminal 140 remains at the same potential as the secondary winding center tap terminal 120, and no current flows through the capacitor 138. However, once one of the lamps 102 or 104 has struck, the capacitor acts to encourage the rapid striking of the other, unstruck lamp in the following way.

When one of the lamps, for the sake of example lamp 104, strikes, its impedance falls substantially as it conducts, and the voltage across the lamp falls to approximately 100 V. However, the voltage across the lower half of the secondary winding 114 between the terminals 118 and 120 which feeds the struck lamp 104 remains at approximately 300 V, resulting in a difference voltage of approximately 200 V developing across the capacitor 138.

The voltage across the upper half of the secondary winding 114 between the terminals 116 and 120 which feeds the unstruck lamp 102 also remains at approximately 300 V. However, the voltage applied to the unstruck lamp 104 is the vector sum of both the voltage across the upper half of the secondary winding 114 and the voltage developed across the capacitor 138. This vector sum, which totals approximately 400 V and so is significantly greater than the voltage of approximately 300 V initially applied to the first striking lamp 104 to cause it to strike, is applied across the unstruck lamp 102. This significantly greater voltage causes the unstruck lamp 102 to rapidly strike.

Once both lamps are struck, as mentioned above, the lamps each present the same impedance, causing the output terminal 140 to assume the same potential as the secondary winding center tap terminal 120, and resulting in no current flow through the capacitor 138. It will thus be appreciated that the capacitor 138 functions only in the period after one of the lamps has struck to cause the remaining lamp to strike rapidly, and that thereafter when both lamps are struck the capacitor 138 is effectively out of circuit. It will also be appreciated that if, instead of the striking sequence described above by way of example, the lamp 102 strikes first, the capacitor 138 then acts in an analogous manner to that described above to hasten the striking of the unstruck lamp 104, i.e. the capacitor 138 functions symmetrically to hasten the striking of whichever of the lamps does not strike first.

In addition to its function as a striking aid, the capacitor 138 also serves to provide a parallel path for current supply to one of the lamps if the other lamp ceases to function or is removed.

As referred to above, the resistor 128, since it is connected in series with the primary winding 108, develops across the resistor a voltage which is directly representative of the current drawn by the lamps 102, 104. Although not so shown in FIG. 1, the voltage across the resistor 128 may be sensed, in conventional manner, to produce a signal directly representative of the circuit load current.

Figure 2:
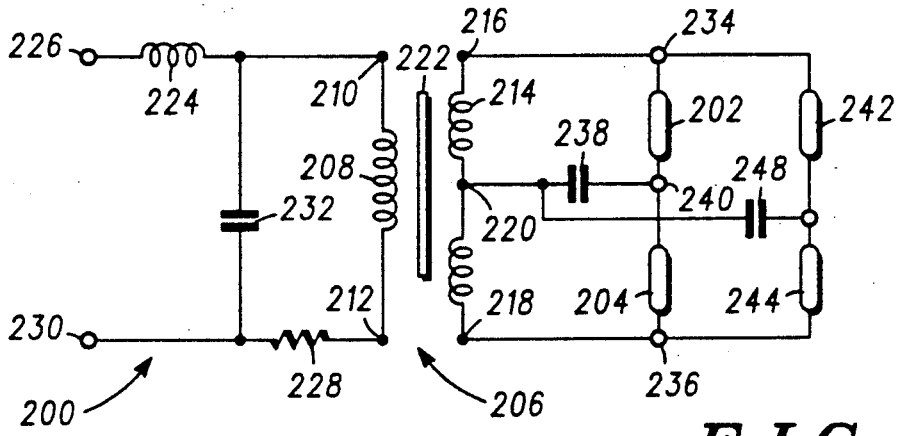

Referring now to FIG. 2, a second driver circuit 200 for driving four gas discharge lamps 202, 204, 242 and 244 includes a transformer 206. The transformer 206 has a primary winding 208 between terminals 210, 212, and has a secondary winding 214 between terminals 216, 218; the secondary winding is center tapped at a terminal 220. The primary and secondary windings are wound on a core 222 in a total turns ratio of 1:2. The terminal 210 of the primary winding 208 is connected, via a series inductor 224 having an inductance of approximately 2 mH, to an input terminal 226. The terminal 212 of the primary winding 208 is connected, via a series resistor 228, to an input terminal 230. The resistor 228 serves to sense load current in operation of the circuit and so has a very low value of typically 0.5 Ω. A capacitor 232 having a value of approximately 0.015 μF is connected in parallel with the primary winding 208 between the terminal 210 of the primary winding and the input terminal 230.

The secondary winding terminals 216 and 218 are connected directly to output terminals 234 and 236 respectively. The secondary winding terminal 220 is connected, via a series capacitor 238 having a value of approximately 0.01 μF, to an output terminal 240. The gas discharge lamps 202, 204 (which may typically be conventional fluorescent lamps) are connected in series between the output terminals 234 and 240 and between the output terminals 240 and 236 respectively. The gas discharge lamps 242, 244 (which like the lamps 202, 204 may typically be conventional fluorescent lamps) are connected in series in a parallel path with the lamps 202, 204 between the output terminals 234 and 236, the mid-point of the lamps 242, 244 being connected via an output terminal 246. The output terminal 246 is connected, via a series capacitor 248 having a value of approximately 0.01 μF, to the secondary winding center tap terminal 220.

In use, the second driver circuit 200 functions in exactly the same manner as that already described above in relation to the similar first driver circuit 100 of FIG. 1. Each pair of lamps 202, 204 and 242, 244 in FIG. 2 are connected in series paths between the output terminals 234, 236 in the same way as the pair of lamps 102, 104 in FIG. 1, and each pair of lamps 202, 204 and 242, 244 in FIG. 2 have their mid-points 240, 246 connected to the secondary winding center tap terminal 220 via respective capacitors 238, 248 in the same way as the pair of lamps 102, 104 in FIG. 1. Thus each pair of lamps 202, 204 and 242, 244 in FIG. 2 function in exactly the same manner as already described with respect to the lamps 102, 104 in FIG. 1, each of the capacitors 238, 248 serving as a striking aid and a parallel current supply path for its respective pair of lamps 202, 204 and 242, 244 in the same way as the capacitor 138 in FIG. 1.

Figure 3:
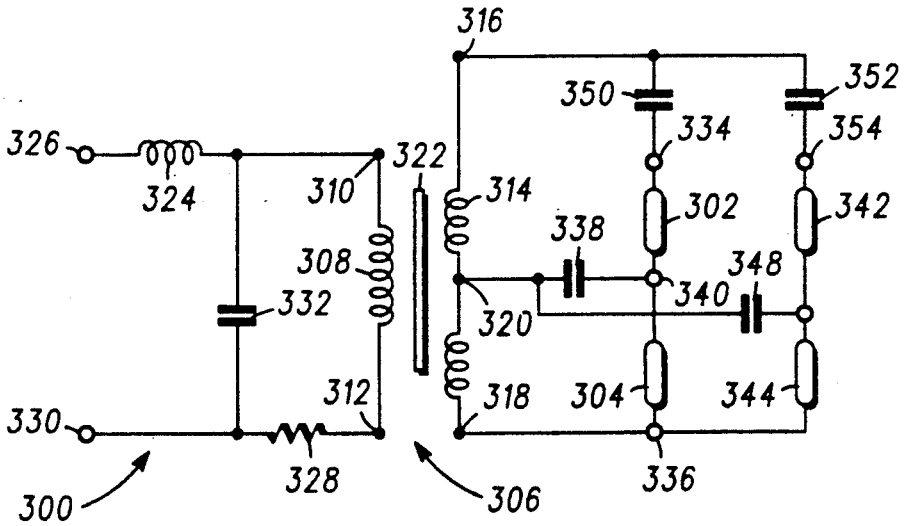

Referring now to FIG. 3, a third driver circuit 300, similar to the second driver circuit of FIG. 2, for driving four gas discharge lamps 302, 304, 342 and 344 includes a transformer 306. The transformer 306 has a primary winding 308 between terminals 310, 312, and has a secondary winding 314 between terminals 316, 318; the secondary winding is tapped at a terminal 320. The tapping of the terminal 320 is so spaced along the length of the secondary winding 314 as to produce upper and lower windings, as seen in FIG. 3, having a turns ratio of 2:1. The primary and secondary windings are wound on a core 322 in a total turns ratio of 1:3. The terminal 310 of the primary winding 308 is connected, via a series inductor 324 having an inductance of approximately 2 mH, to an input terminal 326. The terminal 312 of the primary winding 308 is connected, via a series resistor 328, to an input terminal 330. The resistor 328 serves to sense load current in operation of the circuit and so has a very low value of typically 0.5 Ω. A capacitor 332 having a value of approximately 0.015 μF is connected in parallel with the primary winding 308 between the terminal 310 of the primary winding and the input terminal 330.

The secondary winding terminal 316 is connected to output terminal 334 via a capacitor 350 having a value of approximately 0.0056 μF, and the secondary winding terminal 318 is connected directly to output terminal 336. The secondary winding terminal 320 is connected, via a series capacitor 338 having a value of approximately 0.01 μF, to an output terminal 340. The gas discharge lamps 302, 304 (which may typically be conventional fluorescent lamps) are connected in series between the output terminals 334 and 336, the lamp 302 being connected directly between the output terminals 334 and 340, and the lamp 304 being connected directly between the output terminals 340 and 336. The secondary winding terminal 316 is connected to output terminal 354 via a capacitor 352 having a value of approximately 0.0056 μF. The gas discharge lamps 342, 344 (which like the lamps 302, 304 may typically be conventional fluorescent lamps) are connected in series in a parallel path with the lamps 302, 304 between the output terminals 354 and 336, the lamp 342 being connected directly between the output terminal 354 and an output terminal 346, and the lamp 344 being connected directly between the output terminals 346 and 336. The output terminal 346 is connected, via a series capacitor 348 having a value of approximately 0.01 μF, to the secondary winding tap terminal 320.

As noted above, the third driver circuit 300 shown in FIG. 3, is similar to the already described second driver circuit 200 shown in FIG. 2, and differs therefrom in the inclusion of the two capacitors 350, 352 and in the ratio of the upper and lower windings of the transformer secondary winding. In use, the third driver circuit 300 functions in exactly the same manner as the second driver circuit 200 of FIG. 2, the additional capacitors 350 and 352 serving to provide increased voltage across the pair of lamps 342, 344 and the lamps 302, 304 respectively if one of the pairs of lamps strikes first while the other pair of lamps remains unstruck. Without the capacitors 350, 352 (as in the circuit of FIG. 2), if the lamps 302, 304 strike first, the voltage across the total transformer secondary winding will fall to approximately 200 V as the lamps 302, 304 conduct; this voltage may be insufficient to cause the unstruck lamps 342, 344 to strike if the lamps are of certain common types which require a higher striking voltage. The capacitor 350 serves to ameliorate this condition, since a voltage is developed across the capacitor as the lamps 302, 304 conduct, which voltage acts to increase the voltage at the output terminal 334 and so to increase the voltage across the unstruck lamps 342, 344. It will be appreciated that the capacitor 352 serves in an analogous way to enhance striking of the lamps 302, 304 if the lamps 342, 344 strike first.

Figure 4:
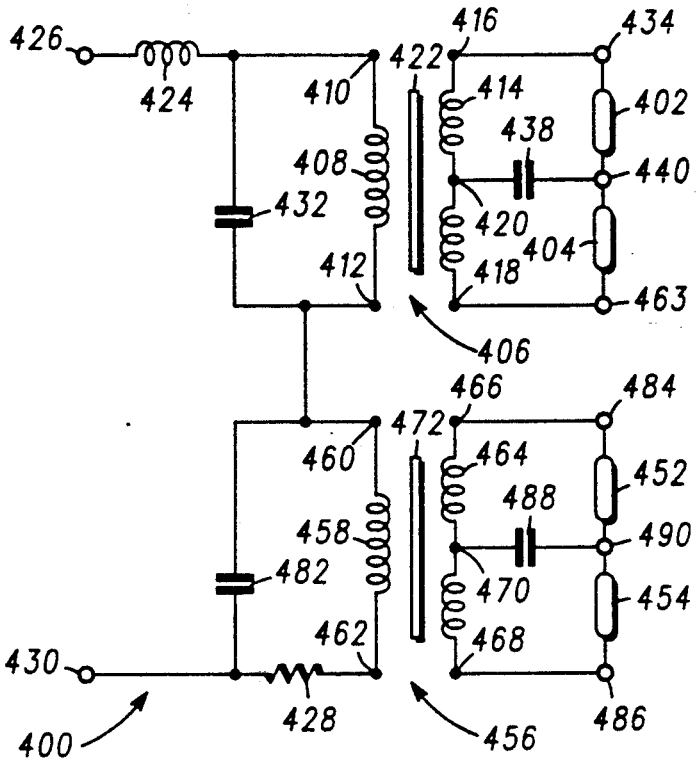

Referring now to FIG. 4, a fourth driver circuit 400 for driving four gas discharge lamps 402, 404, 452 and 454 includes identical first and second transformers 406 and 456. The first transformer 406 has a primary winding 408 between terminals 410, 412, and has a secondary winding 414 between terminals 416, 418; the secondary winding is center tapped at a terminal 420. The primary and secondary windings are wound on a core 422 in a total turns ratio of 1:4. The terminal 410 of the primary winding 408 is connected, via a series inductor 424 having an inductance of approximately 2 mH, to an input terminal 426. A capacitor 432 having a value of approximately 0.0075 μF is connected in parallel with the primary winding 408 between the terminals 410 and 412 of the primary winding. The secondary winding terminals 416 and 418 are connected directly to output terminals 434 and 436 respectively. The secondary winding terminal 420 is connected, via a series capacitor 438 having a value of approximately 0.01 μF, to an output terminal 440. The gas discharge lamps 402, 404 (which may typically be conventional fluorescent lamps) are connected in series between the output terminals 434 and 440 and between the output terminals 440 and 436 respectively.

The second transformer 456 has a primary winding 458 between terminals 460, 462, and has a secondary winding 464 between terminals 466, 468; the secondary winding is center tapped at a terminal 470. The terminal 412 of the first transformer primary winding 408 is connected to the terminal 460 of the second transformer primary winding 458. The primary and secondary windings of the second transformer 456 are wound on a core 472 in a total turns ratio of 1:4. A capacitor 482 having a value of approximately 0.0075 μF is connected in parallel with the primary winding 458 between the terminals 460 and 462 of the primary winding. The terminal 462 of the primary winding 458 is connected, via a series resistor 428, to an input terminal 430. The resistor 428 serves to sense load current in operation of the circuit and so has a very low value of typically 0.5 Ω. The secondary winding terminals 466 and 468 are connected directly to output terminals 484 and 486 respectively. The secondary winding terminal 470 is connected, via a series capacitor 488 having a value of approximately 0.01 μF, to an output terminal 490. The gas discharge lamps 452, 454 (which may typically be conventional fluorescent lamps) are connected in series between the output terminals 484 and 490 and between the output terminals 490 and 486 respectively.

It will be appreciated that the fourth driver circuit 400 is similar to the first driver circuit 100 shown in FIG. 1, the single transformer 106 driving the two lamps 102 and 104 via the capacitor 138 in FIG. 1 being replaced by two similar transformers 406 and 456, each driving two lamps 402, 404 and 452, 454 via respective capacitors 438 and 488. It will be appreciated that the capacitor 132 in FIG. 1 has been replaced in the driver circuit of FIG. 4 by the two series capacitances 432 and 482. It will be understood that the two capacitances 432 and 482 connected in series have the same effective capacitance as the capacitor 132 in FIG. 1, and that thus the fourth driver circuit of FIG. 4 has the same effective LC oscillator circuit as the driver circuit of FIG. 1. It will thus be appreciated that the same high-frequency voltage as generated in the circuit of FIG. 1 is generated in the driver circuit of FIG. 4, where it is applied between the primary winding terminals 410 and 462 and so is divided equally across the primary windings 408, 458 of the the two transformers 406, 456. Each of the transformers 406, 456 in the circuit of FIG. 4 has twice the step-up ratio of the transformer 106 in FIG. 1, to compensate for the high-frequency voltage from the LC oscillator being divided across the two series-connected primary windings 408 and 458, resulting in each of the secondary windings 414, 464 receiving the same voltage as the secondary winding 114 in FIG. 1. Thus, it will be appreciated that each pair of lamps 402, 404 and 452, 454 in the driver circuit of FIG. 4 are driven in an identical manner to those in the already described driver circuit of FIG. 1, each of the capacitors 438 and 488 serving as a striking aid and a parallel current supply path for its respective pair of lamps 402, 404 and 452, 454 in the same way as the capacitor 138 in FIG. 1.

Figure 5:
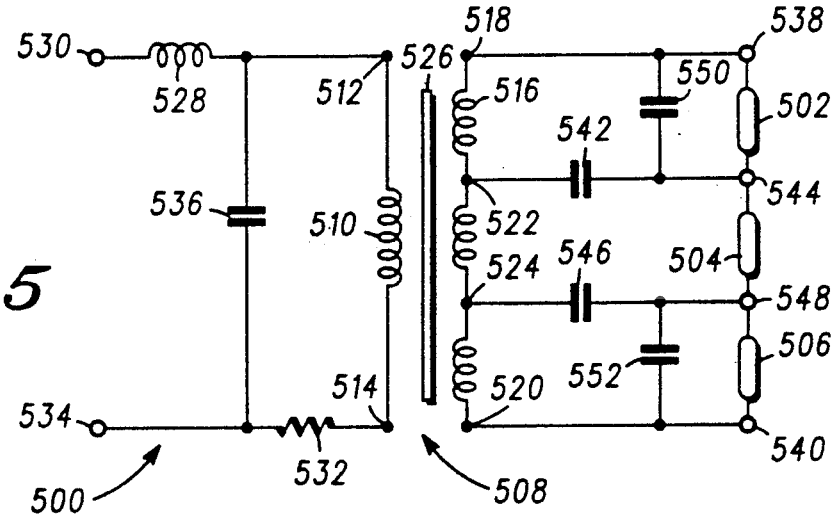

Referring now to FIG. 5, a fifth driver circuit 500 for driving three gas discharge lamps 502, 504 and 506 includes a transformer 508. The transformer 508 has a primary winding 510 between terminals 512, 514, and has a secondary winding 516 between terminals 518, 520; the secondary winding is tapped at one-third and at two-thirds along its length at terminals 522 and 524 respectively. The primary and secondary windings are wound on a core 526 in a total turns ratio of 1:3. The terminal 512 of the primary winding 510 is connected, via a series inductor 528 having an inductance of approximately 2 mH, to an input terminal 530. The terminal 514 of the primary winding 510 is connected, via a series resistor 532, to an input terminal 534. The resistor 532 serves to sense load current in operation of the circuit and so has a very low value of typically 0.5 Ω. A capacitor 536 having a value of approximately 0.015 μF is connected in parallel with the primary winding 510 between the terminal 512 of the primary winding and the input terminal 534.

The secondary winding terminals 518 and 520 are connected directly to output terminals 538 and 540 respectively. The secondary winding terminal 522 is connected, via a series capacitor 542 having a value of approximately 0.01 μF, to an output terminal 544. The gas discharge lamps 502, 504, 506 (which may typically be conventional fluorescent lamps) are connected in series between the output terminals 538 and 540 via the output terminals 544 and 548 respectively. A capacitor 550 (having a value of approximately 470 pF) is connected, in parallel with the lamp 502, between the output terminals 538 and 544. A capacitor 552 (having a value of approximately 470 pF) is connected, in parallel with the lamp 506, between the output terminals 548 and 540.

In use, the fifth driver circuit 500 functions in an analogous manner to that already described above in relation to the first driver circuit 100 of FIG. 1. The inductor 528 and the capacitor 536 form an LC resonant circuit which produces across the terminals 512, 514 a high-frequency, high voltage output. This resonant circuit output is stepped up by a factor of three and transformed and applied between the output terminals 538, 540 across the three series-connected lamps 502, 504, 506. Thus, a voltage equal to the resonant circuit output voltage is applied across each of the lamps. The two capacitors 542, 546 serve the same function as the capacitor 138 in FIG. 1: while none of the lamps are struck, no voltages are developed across the capacitors 542, 546, but when one of the lamps strikes the capacitors function as striking aids to promote rapid striking of the remaining lamps.

If the lamp 502 strikes first, its impedance falls as it begins to conduct and the capacitor 542 begins to charge. In exactly the same way that the charging of the capacitor 138 increases the voltage applied to the unstruck lamp 102 or 104 in FIG. 1, the charging of the capacitor 542 increases the voltage applied across the remaining unstruck lamps 504, 506 and encourages them to strike. If the lamp 506 strikes first, the capacitor 546 similarly charges and increases the voltage applied across the remaining unstruck lamps 502, 504 and encourages them to strike.

However, if the lamp 504 strikes first, both the capacitor 542 and the capacitor 546 charge and respectively increase the voltages applied to the unstruck lamps 502 and 506. In order to encourage the lamp 504 to strike first, the capacitors 550 and 552 are connected respectively in parallel with the lamps 502 and 506. The capacitors 550 and 552 have low values and serve to slightly reduce the starting voltage applied to the lamps 502 and 506 respectively. This slight reduction is typically enough to cause the lamp 504 to strike before either of the lamps 502 or 506, which are subsequently caused to strike rapidly after the striking of the lamp 504 by the action of the capacitors 542 and 546 explained above. Once the lamps 502 and 506 have struck, the capacitors 550 and 552 have no significant effect on the operation of the lamps, since the impedance of the capacitors is considerably less than the impedance of the struck lamps, resulting in substantially all of the transformer secondary current flowing through the lamps and an insignificant amount flowing through the capacitors 550 and 552.

Figure 6:
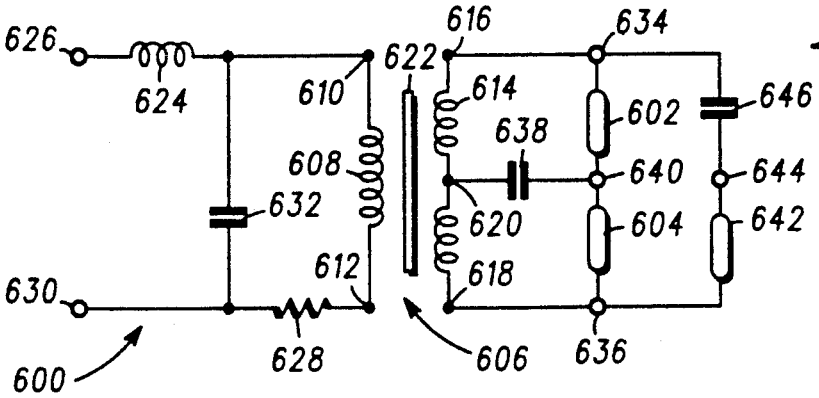

Referring now to FIG. 6, a sixth driver circuit 600 for driving three gas discharge lamps 602, 604 and 642 includes a transformer 606. The transformer 606 has a primary winding 608 between terminals 610, 612, and has a secondary winding 614 between terminals 616, 618; the secondary winding is center tapped at a terminal 620. The primary and secondary windings are wound on a core 622 in a total turns ratio of 1:1. The terminal 610 of the primary winding 608 is connected, via a series inductor 624 having an inductance of approximately 2 mH, to an input terminal 626. The terminal 612 of the primary winding 608 is connected, via a series resistor 628, to an input terminal 630. The resistor 628 serves to sense load current in operation of the circuit and so has a very low value of typically 0.5 Ω. A capacitor 632 having a value of approximately 0.015 μF is connected in parallel with the primary winding 608 between the terminal 610 of the primary winding and the input terminal 630.

The secondary winding terminals 616 and 618 are connected directly to output terminals 634 and 636 respectively. The secondary winding terminal 620 is connected, via a series capacitor 638 having a value of approximately 0.01 μF, to an output terminal 640. The gas discharge lamps 602, 604 (which may typically be conventional fluorescent lamps) are connected in series between the output terminals 634 and 640 and between the output terminals, 640 and 636 respectively. The gas discharge lamp 642 (which like the lamps 202, 204 may typically be a conventional fluorescent lamp) is connected between the output terminal 636 and a further output terminal 644. A capacitor 646, having a value of approximately 0.0056 μF, is connected between the output terminals 634 and 644 in series with the lamp 642 and in parallel with the lamps 602 and 604.

In use, the sixth driver circuit 600 functions in a similar manner as that already described above in relation to the similar first driver circuit 100 of FIG. 1. The pair of lamps 602, 604 in FIG. 6 are connected in a series path between the output terminals 634, 636 in the same way as the pair of lamps 102, 104 in FIG. 1, and the lamps 602, 604 in FIG. 6 have their mid-point 640 connected to the secondary winding center tap terminal 620 via capacitor 638 in the same way as the pair of lamps 102, 104 in FIG. 1. Thus, the pair of lamps 602, 604 in FIG. 6 function in exactly the same manner as already described with respect to the lamps 102, 104 in FIG. 1, the capacitor 638 serving as a striking aid and a parallel current supply path for the pair of lamps 602, 604 in the same way as the capacitor 138 in FIG. 1. The lamp 642, connected in parallel with the pair of lamps 602, 604, is driven from the same voltage across the output terminals 634 and 636, the capacitor 646 serving the same purpose as the capacitors 350, 352 in the third driver circuit 300 described above in relation to FIG. 3: if the lamp 642 strikes first, a voltage develops across the capacitor 646 as the lamp conducts, which voltage increases the voltage at the output terminal 634 and enhances the striking of the pair of lamps 602, 604.

Figure 7:
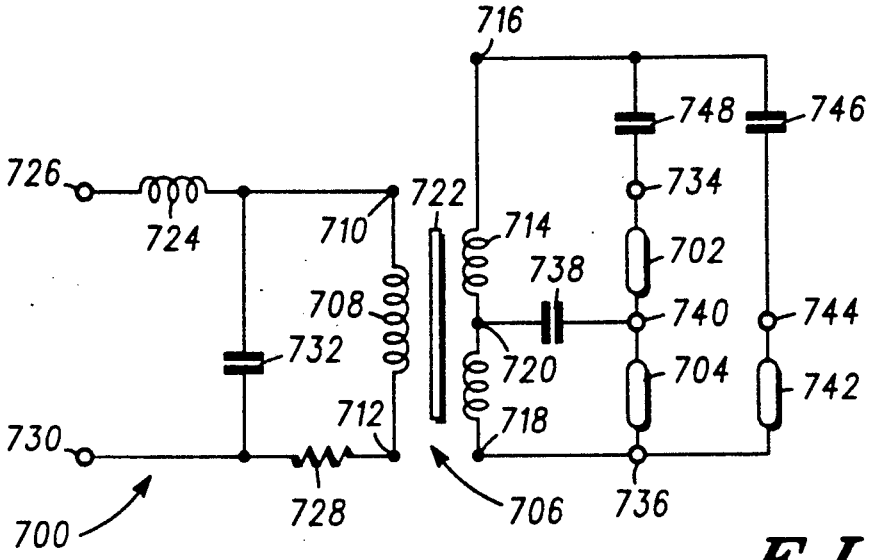

Referring now to FIG. 7, a seventh driver circuit 700, similar to the sixth driver circuit of FIG. 6, for driving three gas discharge lamps 702, 704 and 742 includes a transformer 706. The transformer 706 has a primary winding 708 between terminals 710, 712, and has a secondary winding 714 between terminals 716, 718; the secondary winding is tapped at a terminal 720. The tapping of the terminal 720 is so spaced along the length of the secondary winding 714 as to produce upper and lower windings, as seen in FIG. 7, having a turns ratio of 2:1. The primary and secondary windings are wound on a core 722 in a total turns ratio of 1:1. The terminal 710 of the primary winding 708 is connected, via a series inductor 724 having an inductance of approximately 2 mH, to an input terminal 726. The terminal 712 of the primary winding 708 is connected, via a series resistor 728, to an input terminal 730. The resistor 728 serves to sense load current in operation of the circuit and so has a very low value of typically 0.5 Ω. A capacitor 732 having a value of approximately 0.015 μF is connected in parallel with the primary winding 708 between the terminal 710 of the primary winding and the input terminal 730.

The secondary winding terminal 716 is connected to output terminals 734 and 744 via respective capacitor 748 and 746 having values of approximately 0.0056 μF and 0.0033 μF respectively, and the secondary winding terminal 718 is connected directly to output terminal 736. The secondary winding terminal 720 is connected, via a series capacitor 738 having a value of approximately 0.01 μF, to an output terminal 740. The gas discharge lamp 702 (which may typically be a conventional fluorescent lamp) is connected directly between the output terminals 734 and 740 The lamp 704 (which like the lamp 702 may typically be a conventional fluorescent lamp) is connected between the output terminals 740 and 736. The gas discharge lamp 742 (which like the lamps 702, 704 may typically be a conventional fluorescent lamp) is connected between the output terminals 736 and 744. A capacitor 746, having a value of approximately 0.0033 μF, is connected between the output terminals 734 and 744 in series with the lamp 742 and in parallel with the lamps 702 and 704.

In use, the seventh driver circuit 700 functions in a similar manner as that already described above in relation to the similar sixth driver circuit 600 of FIG. 6. It will be appreciated that the driver circuit of FIG. 7 differs from that of FIG. 6 only in: the position of the tapping point 720 on the secondary winding of the transformer 706, the value of the capacitor 746, and in the presence of the capacitor 748. It will be appreciated that the voltage developed across the total secondary winding 714 in the circuit of FIG. 7 is the same as that in FIG. 6, the relative amounts of this voltage developed between the output terminals 734, 740 and between the output terminals 740, 736 differing in proportion to the difference in upper and lower winding ratios. It will also be appreciated that the additional capacitor 748 serves to provide additional striking voltage to the lamp 742 if the lamps 702 and 704 strike first, in exactly the same way as the capacitor 746 provides additional striking voltage to the lamps 702 and 704 if the lamp 742 strikes first. It will also be appreciated that the values of the capacitors 746 and 748 are chosen so as to produce, in the steady-state running condition of the circuit with all lamps struck, the same current flowing between the output terminals 734 and 736 in each of the parallel paths through the lamps 702 and 704 and through the lamp 742.

Figure 8:
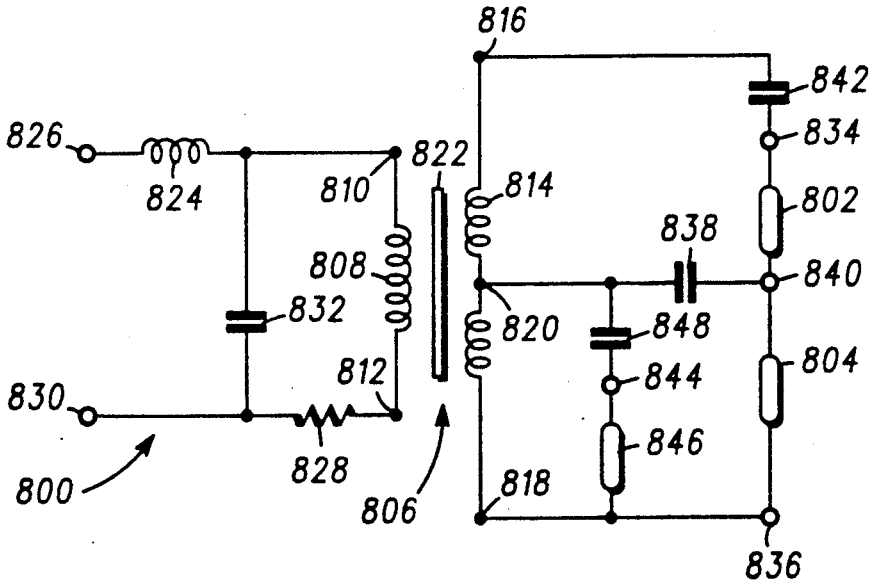

Referring now to FIG. 8, an eighth driver circuit 800 for driving three gas discharge lamps 802, 804 and 846 includes a transformer 806. The transformer 806 has a primary winding 808 between terminals 810, 812, and has a secondary winding 814 between terminals 816, 818; the secondary winding is tapped at a terminal 820. The tapping of the terminal 820 is so spaced along the length of the secondary winding 814 as to produce upper and lower windings, as seen in FIG. 8, having a turns ratio of 1:2. The primary and secondary windings are wound on a core 822 in a total turns ratio of 1:1. The terminal 810 of the primary winding 808 is connected, via a series inductor 824 having an inductance of approximately 2 mH, to an input terminal 826. The terminal 812 of the primary winding 808 is connected, via a series resistor 828, to an input terminal 830. The resistor 828 serves to sense load current in operation of the circuit and so has a very low value of typically 0.5 Ω. A capacitor 832 having a value of approximately 0.015 μF is connected in parallel with the primary winding 808 between the terminal 810 of the primary winding and the input terminal 830.

The secondary winding terminal 816 is connected to output terminal 834 via a capacitor 842 having a value of approximately 0.0033 μF, and the secondary winding terminal 818 is connected directly to output terminal 836. The secondary winding terminal 820 is connected, via a series capacitor 838 having a value of approximately 0.0033 μF, to an output terminal 840. The gas discharge lamp 802 (which may typically be a conventional fluorescent lamp) is connected between the output terminals 834 and 840. The lamp 804 (which like the lamp 802 may typically be a conventional fluorescent lamp) is connected between the output terminals 840 and 836. The gas discharge lamp 846 (which like the lamps 802, 804 may typically be a conventional fluorescent lamp) is connected between the output terminal 836 and a further output terminal 844. The output terminal 844 is connected to the secondary winding terminal 820 via a capacitor 848 (having a value of approximately 0.0056 μF).

In use, the eighth driver circuit 800 functions in a similar manner to that already described above in relation to the similar seventh driver circuit 700 of FIG. 7. It will be seen that like the driver circuit of FIG. 7, the eighth driver circuit 800 has two lamps 802, 804 connected in series with a capacitor 842 across a transformer secondary winding 814, and the common connection (terminal 840) of these two lamps is coupled to a tapping on the secondary winding via a capacitor 838. However, whereas the circuit of FIG. 7 has a third lamp 742 connected (in series with a capacitor 746) across the whole of the secondary winding, in the eighth driver circuit 800 a third lamp 846 is connected (in series with a capacitor 848) across only the lower portion of the secondary winding. It will be appreciated that the voltage developed across the total secondary winding 814 in the circuit of FIG. 8 is the same as that in FIG. 7, and that the lamps 802, 804 function in the same way as in FIG. 7, the capacitor 838 serving to enhance striking of one of these lamps when the other has struck and providing a path for drive current to one of the lamps if the other lamp is removed. The lamp 846 is driven, through the capacitor 848, directly from the lower portion of the secondary winding 814.

It will be appreciated that the capacitor 842 in the eighth driver circuit 800 serves exactly the same purpose as the capacitor 748 in the circuit of FIG. 7, namely to enhance the striking of the lamp 846 if the lamps 802 and 804 strike first. It will also be understood that the capacitor 848 serves to enhance the striking of the lamps 802 and 804 if the lamp 846 should strike before the lamps 802 and 804. It will also be appreciated that the values of the capacitors 842 and 848 are chosen so as to produce, in the steady-state running condition of the circuit with all lamps struck, the same current flowing between the output terminals 834 and 836 as flows through the lamp 846.

It will be appreciated that various other modifications or alternatives to the above described embodiments will be apparent to the man skilled in the art without departing from the inventive concept of driving a plurality of gas discharge lamps in series from a transformer secondary winding and coupling, via a capacitance, a point connected intermediate between the lamps to an intermediate tap on the secondary winding.

I claim:

1. A circuit for driving a plurality of gas discharge lamps, the circuit comprising:

input terminals for connection to a source of voltage supply;

output terminals for connection to a plurality of gas discharge lamps in series;

high-frequency drive means coupled between the input terminals and the output terminals for producing a high-frequency drive voltage at the output terminals;

a transformer having a primary winding coupled to the input terminals and having a secondary winding coupled to the output terminals, the secondary winding of the transformer being coupled at first and second points along its length to respective first and second ones of the output terminals for connection across the plurality of gas discharge lamps in series, and being coupled at at least one point intermediate between the first and second points to an intermediate one of the output terminals for connection to the gas discharge lamps at a point intermediate therebetween, and the at least one intermediate point of the secondary winding of the transformer being coupled to the intermediate output terminal by a capacitance.

2. A circuit according to claim 1 wherein the at least one intermediate point of the secondary winding of the transformer is coupled to a plurality of intermediate ones of the output terminals by respective capacitances, the plurality of intermediate ones of the output terminals being arranged for connection to respective intermediate points between each of a plurality of sets of gas discharge lamps in series, the first and second output terminals being arranged for connection in parallel across each of the sets of gas discharge lamps.

3. A circuit according to claim 2 wherein the first and second points of the secondary winding of the transformer are arranged to be coupled across the plurality of sets of gas discharge lamps via respective capacitances connected in series with each of the plurality of sets of gas discharge lamps.

4. A circuit according to claim 1 wherein the high-frequency drive means includes an inductance connected in series with the primary winding of the transformer, and a capacitance coupled in parallel with the primary winding of the transformer to form a resonant LC oscillator.

5. A circuit according to claim 4 further comprising a load current sensing resistance connected between the capacitance and the primary winding of the transformer in series with the primary winding of the transformer.

6. A circuit according to claim 1 comprising a plurality of transformers having primary windings coupled in series between the input terminals and having secondary windings each coupled at first and second points along their lengths to respective first and second ones of respective pairs of the output terminals for connection across respective sets of pluralities of gas discharge lamps in series, each of the secondary windings being coupled at at least one point intermediate between their respective first and second points to a respective intermediate one of the output terminals for connection respectively to each of the sets gas discharge lamps at a point intermediate therebetween, and each of the intermediate points of the secondary winding of the transformer being coupled to its respective intermediate output terminal by a respective capacitance.

7. A circuit according to claim 6 wherein the high-frequency drive means includes an inductance connected in series with the primary winding of the transformer, and a plurality of capacitances respectively coupled in parallel with each of the primary windings of the transformers to form a resonant LC oscillator.

8. A circuit according to claim 7 further comprising a load current sensing resistance connected between the capacitance and the primary windings of the transformers in series with the primary windings of the transformers.

9. A circuit according to claim 1 for driving at least three gas discharge lamps wherein the secondary winding of the transformer is coupled at a plurality of spaced intermediate points between the first and second points to respective intermediate ones of the output terminals for connection respectively to the gas discharge lamps at spaced intermediate points therebetween, and each of the intermediate points of the secondary winding of the transformer being coupled its respective intermediate output terminal by a respective capacitance.

10. A circuit according to claim 9 further comprising at least one capacitance connected between two adjacent output terminals so as to be connected in parallel with one of the gas discharge lamps to encourage others of the gas discharge lamps to strike first.

11. A circuit according to claim 10 wherein respective capacitances are connected between respective pairs of adjacent output terminals so as to be connected in parallel with all except one of the gas discharge lamps to encourage the excepted gas discharge lamp to strike first.

12. A circuit according to claim 1 further comprising a further capacitance connected between the first output terminal and a further one of the output terminals, the further output terminal being arranged for connection of a further gas discharge lamp between the further output terminal and the second output terminal, whereby the further capacitance encourages striking of the other gas discharge lamps connected between the first and second output terminals if the further gas discharge lamp strikes first.

13. A circuit according to claim 12 further comprising an additional capacitance arranged for connection in parallel with said other gas discharge lamps connected between the first and second output terminals so as to encourage striking of the further gas discharge lamp if said other gas discharge lamps strike first.

14. A circuit according to claim 1 further comprising a further capacitance connected between the at least one intermediate point of the secondary winding of the transformer and a further one of the output terminals, the further output terminal being arranged for connection of a further gas discharge lamp between the further output terminal and the second output terminal, whereby the further capacitance encourages striking of the other gas discharge lamps connected between the first and second output terminals if the further gas discharge lamp strikes first.

15. A circuit according to claim 14 further comprising an additional capacitance arranged for connection in parallel with said other gas discharge lamps connected between the first and second output terminals so as to encourage striking of the further gas discharge lamp if said other gas discharge lamps strike first.

16. A circuit for driving at least first and second gas discharge lamps, the circuit comprising:

input terminals for connection to a source of voltage supply;

output terminals for connection to the first and second gas discharge lamps in series;

a transformer having a primary winding coupled to the input terminals and having a secondary winding coupled to the output terminals, a high-frequency LC oscillator connected to the input terminals and to the primary winding of the transformer for producing a high-frequency drive voltage at the transformer;

the secondary winding of the transformer being coupled at first and second points along its length to respective first and second ones of the output terminals for connection across the plurality of gas discharge lamps in series, and being coupled at at least a third point intermediate between the first and second points to a third one of the output terminals for connection to the gas discharge lamps at a point intermediate therebetween, and the third point of the secondary winding of the transformer being coupled to the third output terminal by a capacitance so as to encourage striking of one of the first and second lamps if the other of the first and second lamps strikes first.

* * * * *